US011971234B2

(12) United States Patent
Ewing, Jr.

(10) Patent No.: US 11,971,234 B2
(45) Date of Patent: Apr. 30, 2024

(54) METHOD OF FORMING A CHAMBER IN A BARREL BLANK

(71) Applicant: Paul Lee Ewing, Jr., Knoxville, TN (US)

(72) Inventor: Paul Lee Ewing, Jr., Knoxville, TN (US)

( * ) Notice: Subject to any disclaimer, the term of this patent is extended or adjusted under 35 U.S.C. 154(b) by 0 days.

(21) Appl. No.: 18/102,695

(22) Filed: Jan. 28, 2023

(65) Prior Publication Data

US 2023/0243613 A1 Aug. 3, 2023

Related U.S. Application Data

(60) Provisional application No. 63/306,194, filed on Feb. 3, 2022.

(51) Int. Cl.
*F41A 21/18* (2006.01)
*B21D 51/20* (2006.01)

(52) U.S. Cl.
CPC ..... *F41A 21/18* (2013.01); *B21D 51/20* (2013.01)

(58) Field of Classification Search
CPC ..... F41A 21/12; B21D 51/20
USPC ..... 42/76.1; 89/14.7
See application file for complete search history.

(56) References Cited

U.S. PATENT DOCUMENTS 1,177,983 A * 4/1916 Avid ..... C21D 7/12 408/1 R
6,817,132 B1 * 11/2004 Sirois ..... F41A 21/12 42/76.01
9,404,719 B1 * 8/2016 Bowers ..... F42B 5/025
2011/0010976 A1 * 1/2011 Lippard ..... F41A 21/16 42/2
2015/0027022 A1 * 1/2015 Behling ..... B23D 77/006 408/31
2023/0142727 A1 * 5/2023 Burrow ..... B23D 77/14 408/1 R

* cited by examiner

*Primary Examiner* — Bret Hayes
(74) *Attorney, Agent, or Firm* — Bennet K. Langlotz; Langlotz Patent & Trademark Works, LLC

(57) ABSTRACT

A method of forming a chamber in a barrel blank has the steps of providing an elongated firearm barrel blank defining a bore and having a muzzle end and an opposed breech end, securing the blank in a fixture, determining a first reference location of the bore at a position proximate to the breech end, based on the first reference location, machining a first rough chamber bore at the breech end and along the bore to a selected depth, determining a second reference location of the bore at a position beyond the selected depth, and based on the second reference location, machining a second precision chamber bore. The fixture may be stationary during the steps of determining and machining. The step of determining a first reference location may include probing a surface of the bore and may include probing at least three different positions about the bore.

14 Claims, 7 Drawing Sheets

METHOD OF FORMING A CHAMBER IN A BARREL BLANK

CROSS-REFERENCE TO RELATED APPLICATION

This application claims the benefit of U.S. Provisional Patent Application No. 63/306,194 filed on Feb. 3, 2022, entitled "PRECISION RIFLE CHAMBERING USING AUTOMATED CNC MACHINE TOOL," which is hereby incorporated by reference in its entirety for all that is taught and disclosed therein.

FIELD OF THE INVENTION

The present invention relates to firearms, and more particularly to a method of forming a chamber in a barrel blank that reduces setup and machining time while increasing machining repeatability and maintaining extreme accuracy.

BACKGROUND AND SUMMARY OF THE INVENTION

The methods and technology of chambering a rife for extreme accuracy are not new. Typically, a gunsmith will use a manual lathe, tool room CNC lathe, or to chamber a rifle. Often, the gunsmith and rifle manufacturers will use a "through-the-headstock" method of chambering a barrel. Although the setup among manufacturers and gunsmiths (M&Gs) may vary, they all share several common characteristics.

M&Gs tend to use a lathe in a conventional manner, i.e., the workpiece (barrel) is moving while the tool remains stationary. The tenon and chamber are shaped, threaded, and bored by tools that remain stationary, while the barrel spins in the spindle. Because the bore of the barrel (the internal diameter of the bore), ID, and the outside diameter of the barrel, OD, are not necessarily concentric, i.e., they do not share the same center point, special work holding techniques have been developed over the years by M&Gs to ensure that the ID of the bore is concentric with respect to the boring tools on the lathe.

Several downsides to current chambering techniques exist. First, it is a time-consuming process to manually "indicate-in" the bore. Use of a dial indicator is required because the chamber reamers used need to be aligned both concentrically and axially along the ID of the bore. Second, reduced rigidity is induced by work holding necessary to get proper tool alignment. For custom work, it is not uncommon for bore indication to take an average of 45 minutes or more.

Most rifle barrels are chambered using specially shaped reamers. Reamers follow a predrilled hole, and if used properly, they will produce a very nice, finished product. M&Gs must be very careful to ensure proper setup and boring of the chamber to reduce the chance of "chatter" and excessive total indicator runout, that if allowed may cause a malformed chamber and induced inaccuracies in the machined chamber.

Some M&Gs attempt to shorten chamber machining time by drilling, using roughing reamers, or boring bars to create a roughed in chamber area. However, these techniques all rely upon the barrel's predrilled bore being aligned to the cutting tools and in most cases, but not all, the workpiece (barrel) is moving while the cutting tools may be held stationary.

Therefore, a need exists for a new and improved method of forming a chamber in a barrel blank that reduces setup and machining time while increasing machining repeatability and maintaining extreme accuracy. In this regard, the various embodiments of the present invention substantially fulfill at least some of these needs. In this respect, the method of forming a chamber in a barrel blank according to the present invention substantially departs from the conventional concepts and designs of the prior art, and in doing so provides a method primarily developed for the purpose of reducing setup and machining time while increasing machining repeatability and maintaining extreme accuracy.

The present invention provides an improved method of forming a chamber in a barrel blank, and overcomes the above-mentioned disadvantages and drawbacks of the prior art. As such, the general purpose of the present invention, which will be described subsequently in greater detail, is to provide an improved method of forming a chamber in a barrel blank that has all the advantages of the prior art mentioned above.

To attain this, the preferred embodiment of the present invention essentially comprises the steps of providing an elongated firearm barrel blank defining a bore and having a muzzle end and an opposed breech end, securing the blank in a fixture, determining a reference location of the bore center at a position proximate to the breech end, based reference location, machining a rough chamber bore at the breech end and along the bore to a selected depth, and if necessary, determining a second reference location of the bore at a position beyond the selected depth, and based on the second reference location, machining a second precision chamber bore. The fixture may be stationary during the steps of determining and machining. The step of determining a reference location may include probing a surface of the bore. The step of determining a reference location may include probing at least two different positions about the bore. There are, of course, additional features of the invention that will be described hereinafter and which will form the subject matter of the claims attached.

There has thus been outlined, rather broadly, the more important features of the invention in order that the detailed description thereof that follows may be better understood and in order that the present contribution to the art may be better appreciated.

BRIEF DESCRIPTION OF THE DRAWINGS

The same reference numerals refer to the same parts throughout the various figures.

DESCRIPTION OF THE CURRENT EMBODIMENT

Figure 1:
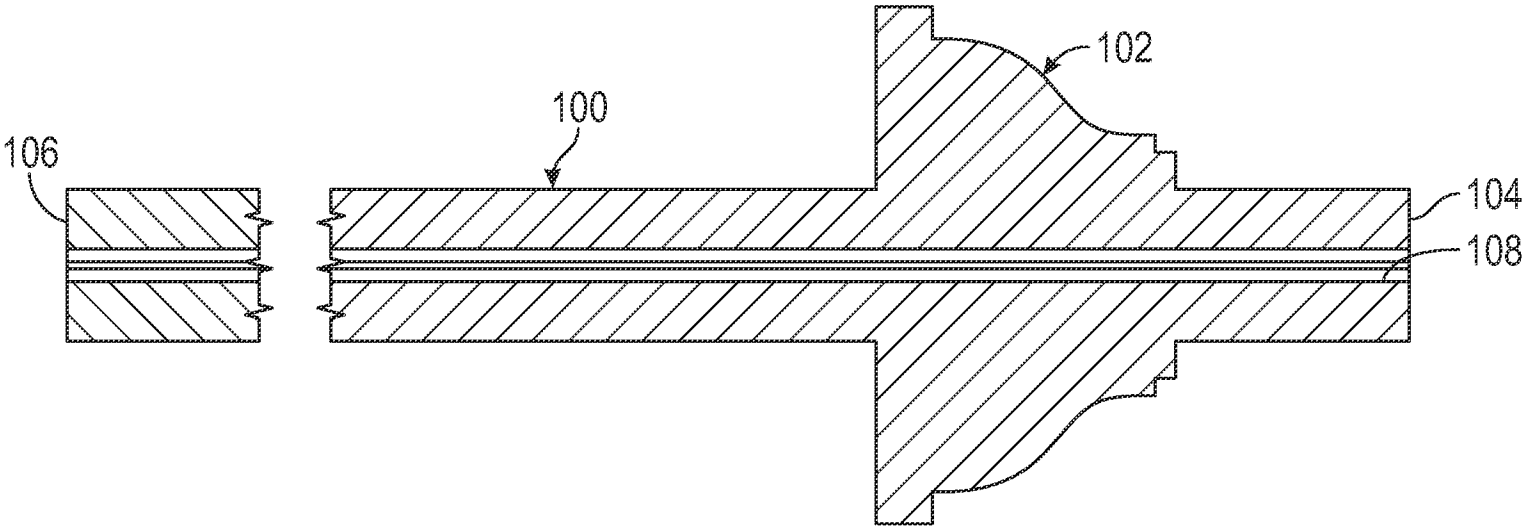
FIG. 1 is a side sectional view of a barrel blank secured in a fixture.

An embodiment of the method of forming a chamber in a barrel blank of the present invention is shown and generally designated by the reference numeral 10.

FIG. 1 illustrates a barrel blank 100 secured in a fixture 102 suitable for use with the improved method of forming a chamber in a barrel blank 10 of the present invention. More particularly, the fixture is a collet chuck in the current invention. The barrel blank has a breech end 104, an opposed muzzle end 106, and defines a bore 108.

Figure 2:
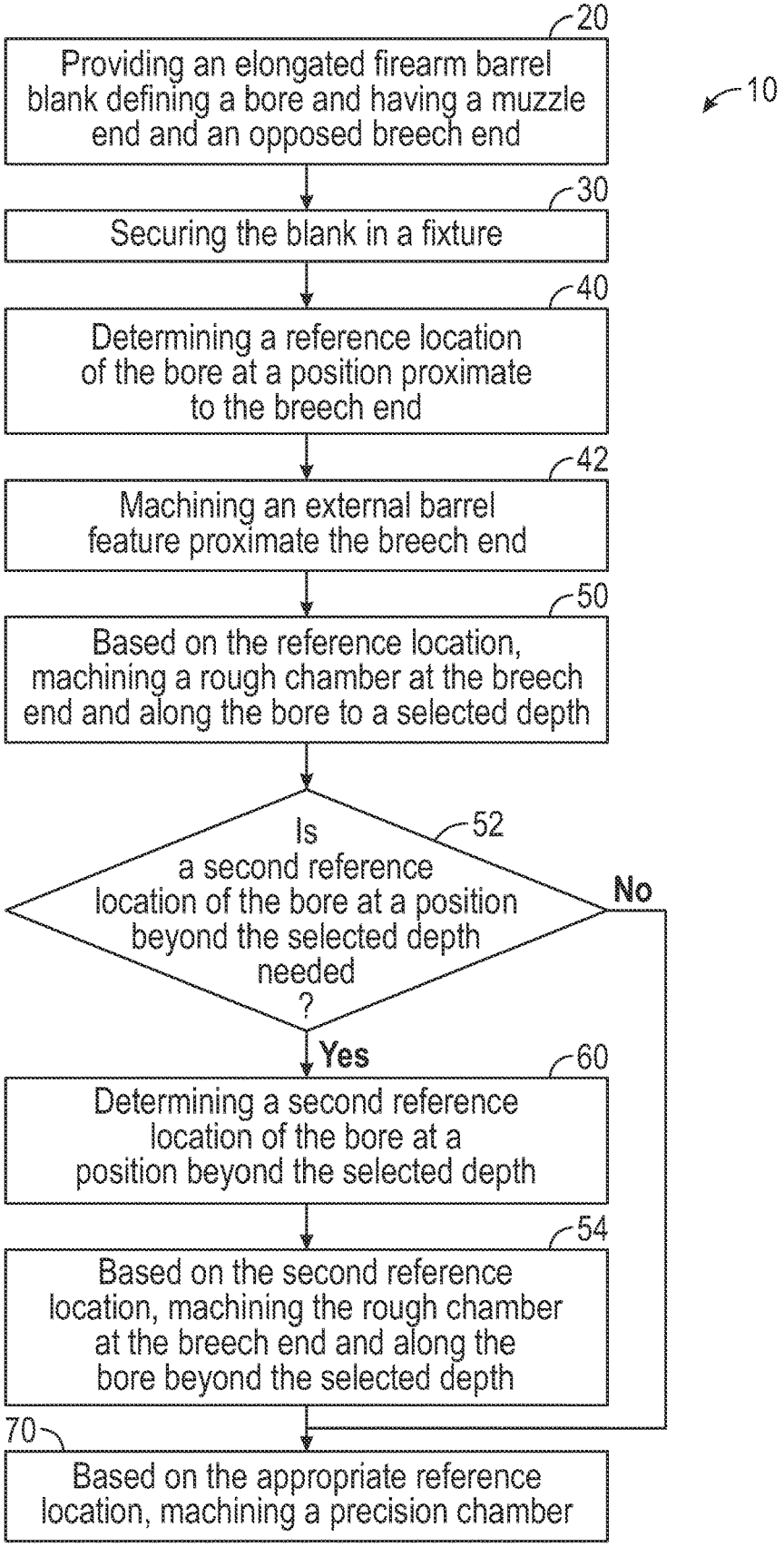
FIG. 2 is a flowchart of the current embodiment of a method of forming a chamber in a barrel blank constructed in accordance with the principles of the present invention.

FIG. 2 illustrates the improved method of forming a chamber in a barrel blank 10 of the present invention. More particularly, the method includes the steps of providing an elongated firearm barrel blank defining a bore and having a muzzle end and an opposed breech end (20), securing the blank in a fixture (30), determining a reference location of the bore at a position proximate to the breech end (40), based on the reference location, machining a rough chamber at the breech end and along the bore to a selected depth (50), determining if a second reference location of the bore at a position beyond the selected depth is needed (52), if the second reference location of the bore is needed, determining a second reference location of the bore at a position beyond the selected depth (60), and based on the second reference location, machining the rough chamber at the beech end and along the bore beyond the selected depth (54). If a second reference location of the bore at a position beyond the selected depth was not needed, or after the competition of step (54), based on the reference location, machining a precision chamber bore (70).

In the current embodiment, the fixture can be stationary during the steps of determining (40) and (60) and machining (50) and (70). The step of determining a first reference location (40) can include probing a surface of the bore. The step of determining a first reference location (40) can include probing at least two different positions about the bore. The provided barrel blank can have a rifled bore with lands and groove, and the step of determining a first reference location (40) can include probing a surface of a groove or land. The step of determining a first reference location (40) can include calculating a center of the bore. The step of machining a first rough chamber (50) can include centering the first rough chamber on the determined bore center. The blank has an outside surface at the breech and determining a reference location in steps (40) and (60) is irrespective of the outside surface. The step of determining a first reference location of the bore (40) can also include the step of machining an external barrel feature proximate the breech end (42). The external feature can include a tenon. The step of machining a second precision chamber bore (70) can include maintaining the barrel blank stationary and operating a machine tool having a moving cutting surface to form the chamber. The step of machining a rough chamber bore (50) can include generating a rough chamber surface. The step of machining a precision chamber bore (70) can include removing the entire rough chamber surface. The step of determining a second reference location of the bore (60) can include inserting a probe having an operational measuring tip and having an elongated body portion having a diameter greater than the barrel blank bore.

Figure 3:
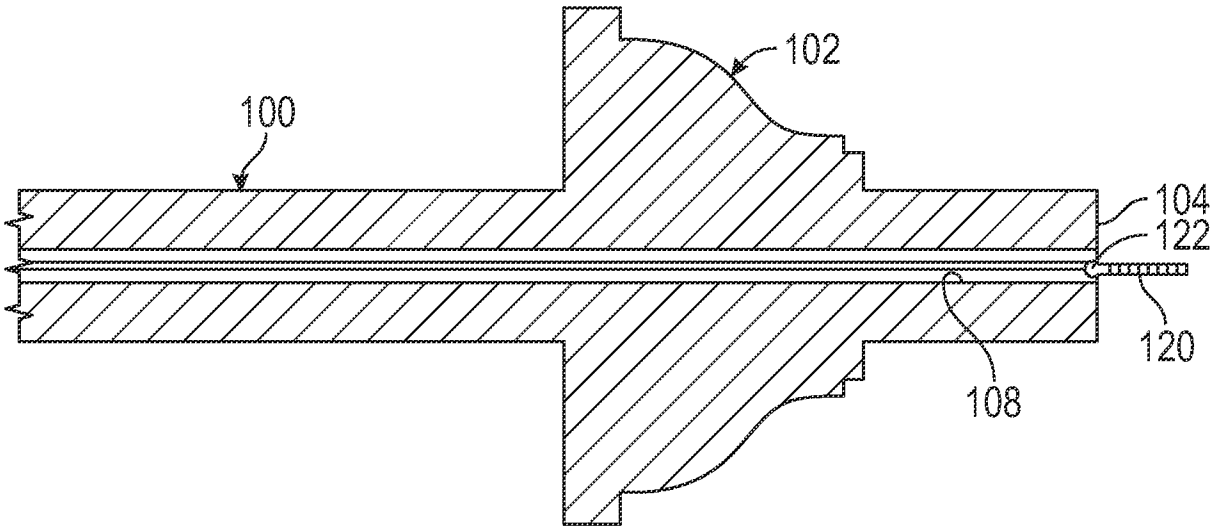
FIG. 3 side sectional view of the barrel blank secured in a fixture of FIG. 1 with a probe in the breech end.
Figure 4A:
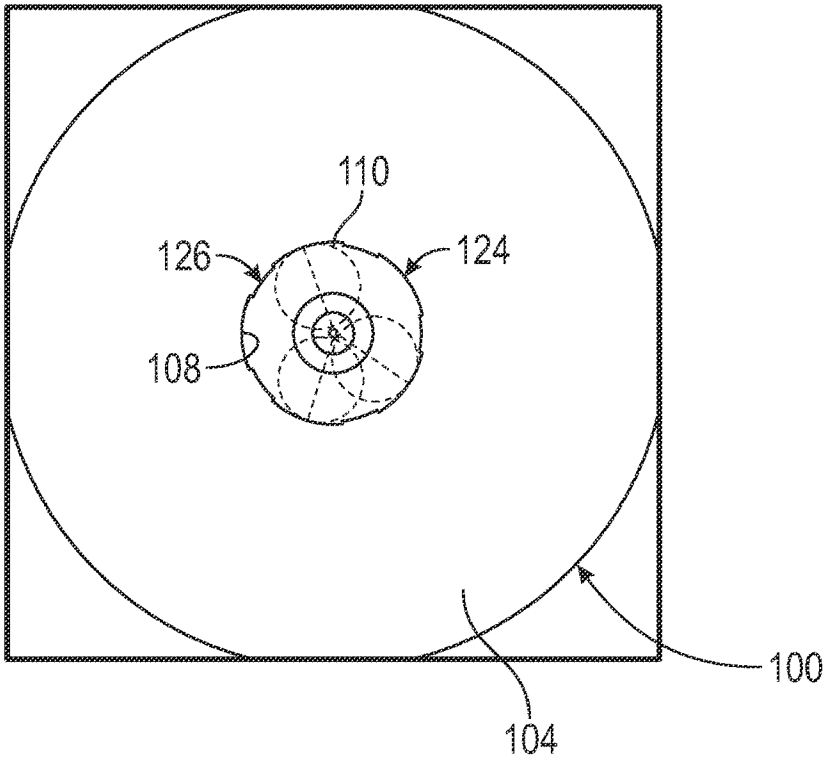
FIG. 4A is a front sectional enlarged view of a portion of FIG. 4.
Figure 4:
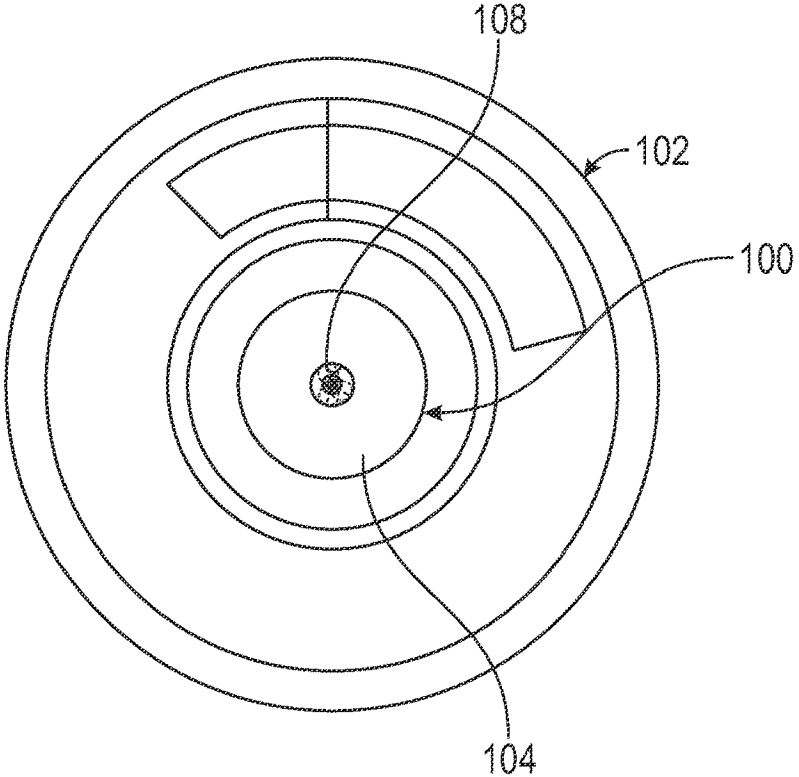
FIG. 4 is a front sectional view of the barrel blank secured in a fixture of FIG. 1 indicating some of the grooves that can be probed to find the center of the barrel bore.

FIGS. 3-4A illustrate the barrel blank 100 secured in a fixture 102 suitable for use with the improved method of forming a chamber in a barrel blank 10 of the present invention. More particularly, the breech end 104 of the bore 108 of the barrel blank is being probed by a probe 120 having a ruby tip 122. It should be appreciated a ruby tipped probe is not essential, and a metal tip may be preferable in some instances. This is accomplished by probing the grooves 124 that are defined between adjacent lands 126 within the bore. It should be appreciated that the lands could also be probed, or a combination of grooves and lands could be probed. At least two probe points 110 identifying the location of two grooves are used to find the center of the bore in the case of the five-groove barrel blank shown, with at least three being preferable for increased accuracy. If the bore of the barrel has four grooves, then at least two grooves and preferably all four grooves are probed to establish probe points for maximum accuracy.

Figure 5:
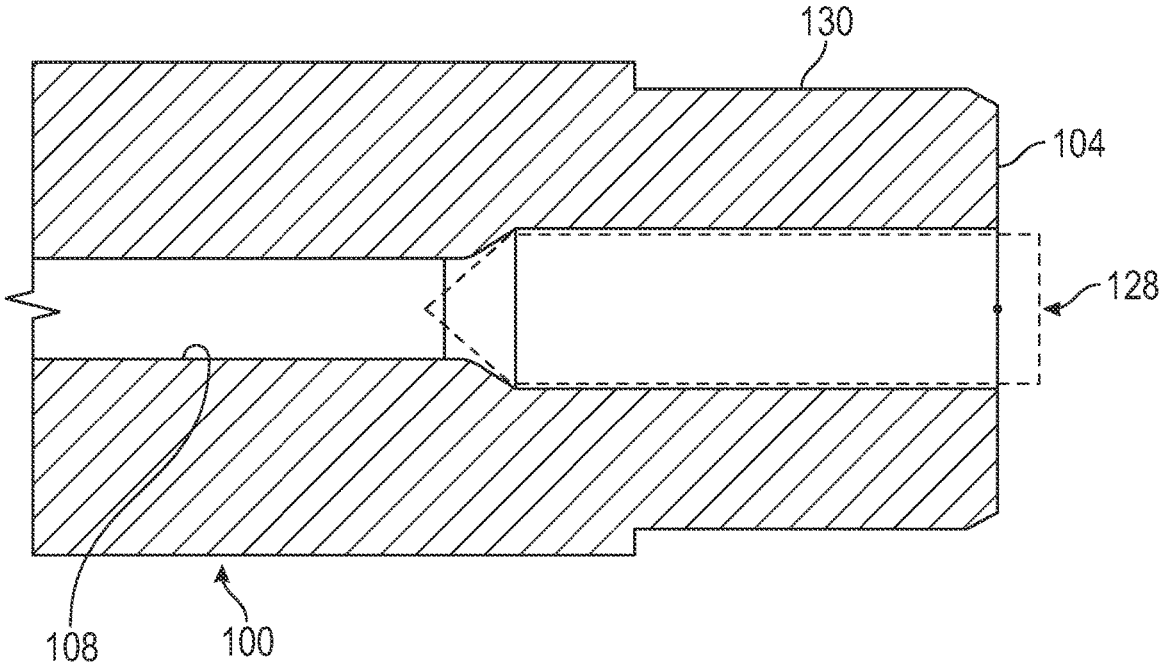
FIG. 5 is a side sectional view of the barrel blank secured in a fixture of FIG. 1 being drilled to allow a probe deeper access into the barrel bore.

FIG. 5 illustrates the barrel blank 100 secured in a fixture 102 suitable for use with the improved method of forming a chamber in a barrel blank 10 of the present invention. More particularly, a drill bit 128 is used to enlarge the breech end 104 of the bore 108 of the barrel blank to enable a probe deeper access into the bore. The drill bit is axially aligned with the center of the bore determined previously. A barrel tenon 130 has already been machined in at least rough form. The tenon may be already finished and threaded utilizing the center of the bore determined previously, or finishing and threading of the tenon may be postponed if deeper probe access into the bore is required to identify a more accurate center of the bore.

Figure 6:
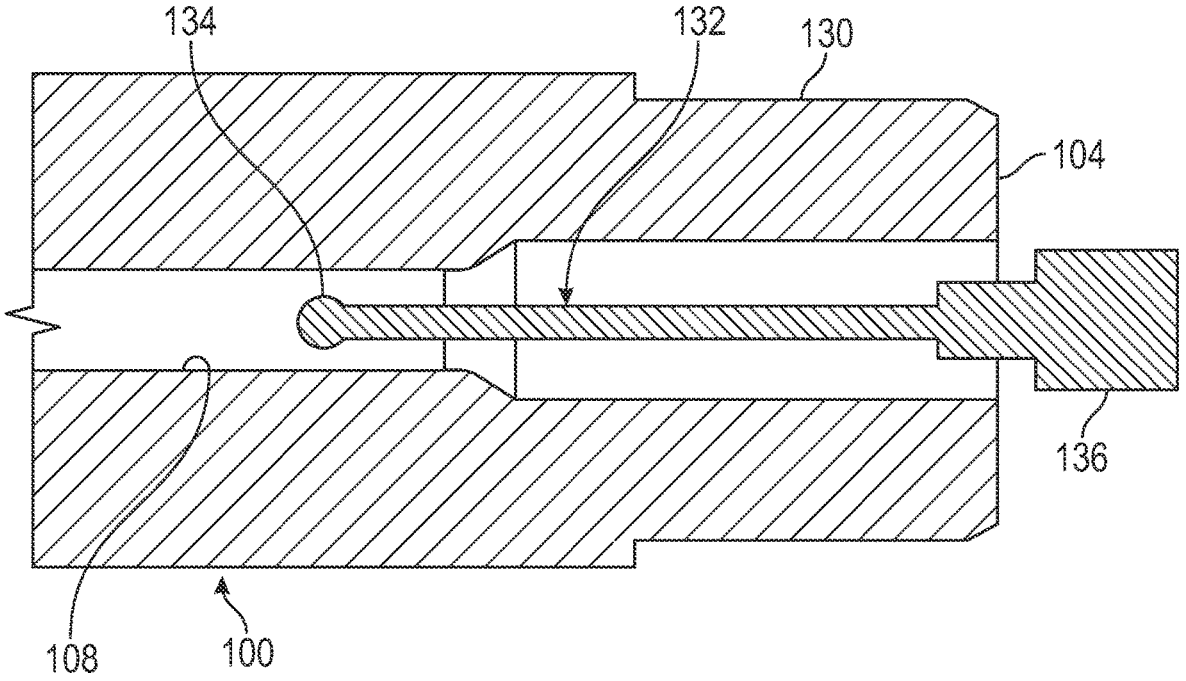
FIG. 6 is a side sectional view of the barrel blank secured in a fixture of FIG. 1 being probed more deeply within the barrel bore.

FIG. 6 illustrates the barrel blank 100 secured in a fixture 102 suitable for use with the improved method of forming a chamber in a barrel blank 10 of the present invention. More particularly, the breech end 104 of the bore 108 of the barrel blank is being probed by a probe 132 having a ruby tip 134 and an enlarged body 136. This is accomplished by probing the grooves that are defined between adjacent lands within the bore, but at a substantially deeper location within the bore now that the breech end of the bore has been enlarged by drilling. This second probing may not be required if the center of the bore can be determined with sufficient accuracy from the first probing. At least two probe points identifying the location of two grooves are used to find the center of the bore in the case of the five-groove barrel blank shown, with three probe points being preferable for increased accuracy. If the bore of the barrel has four grooves, then at least two grooves and preferably all four grooves are probed to establish probe points for maximum accuracy.

Figure 7A:
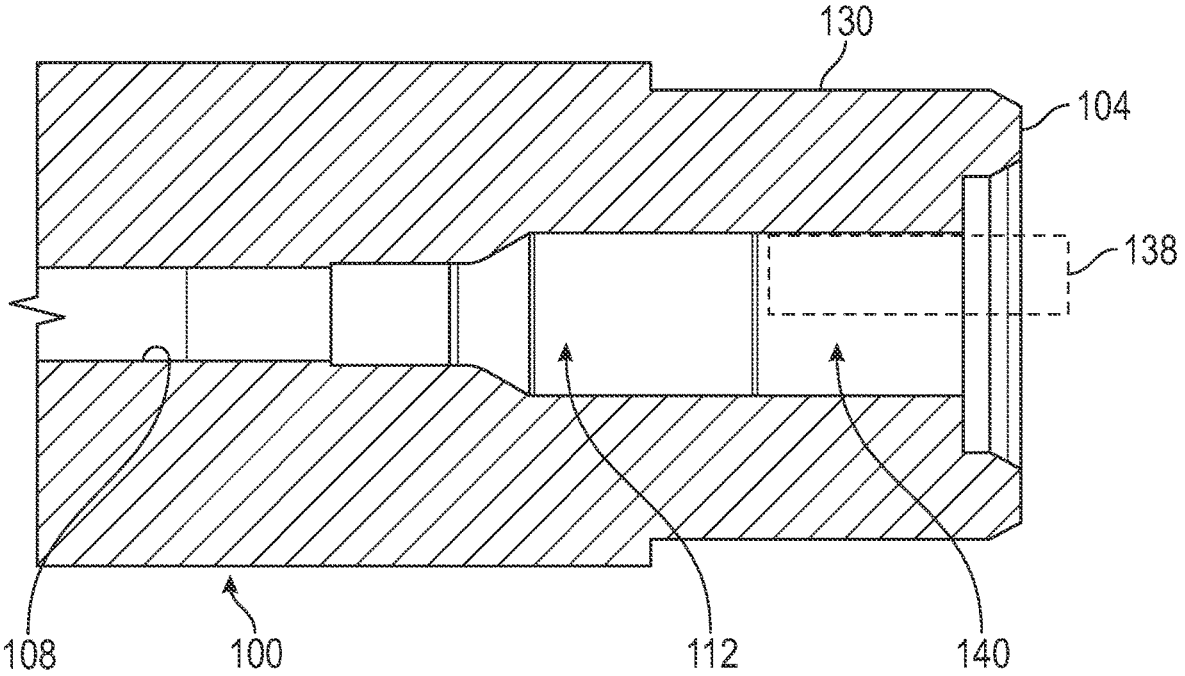
FIG. 7A is a side sectional view of the barrel blank secured in a fixture of FIG. 1 undergoing milling to form the upper chamber.
Figure 7B:
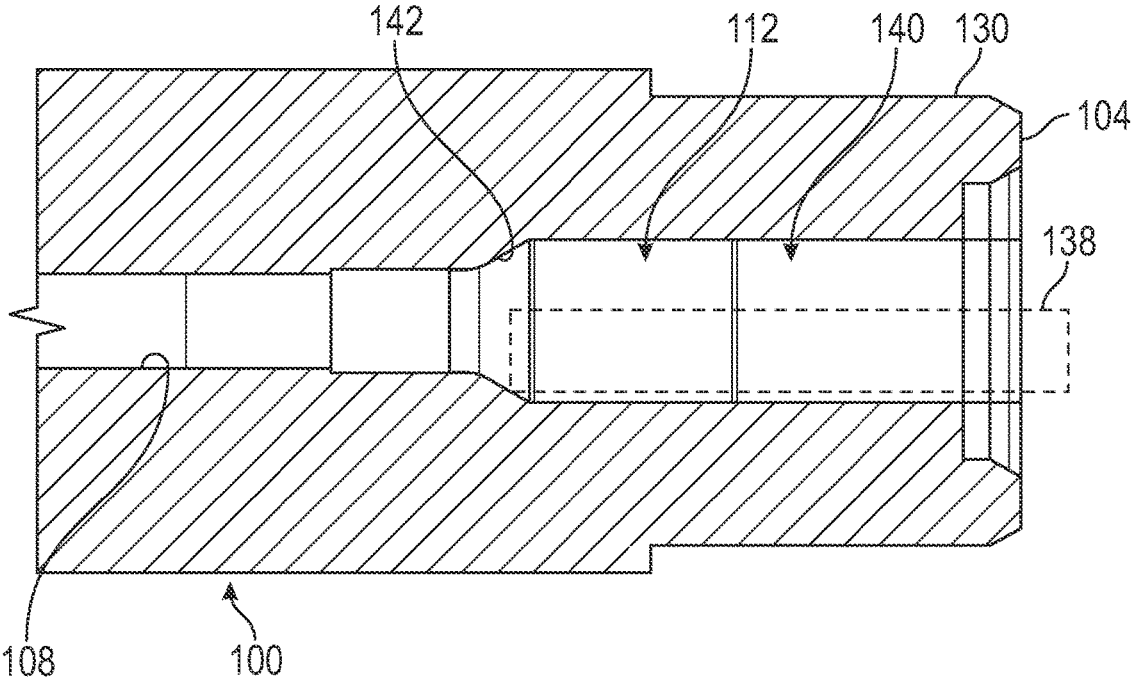
FIG. 7B is a side sectional view of the barrel blank secured in a fixture of FIG. 1 undergoing milling to form the shoulder and fillets.
Figure 7C:
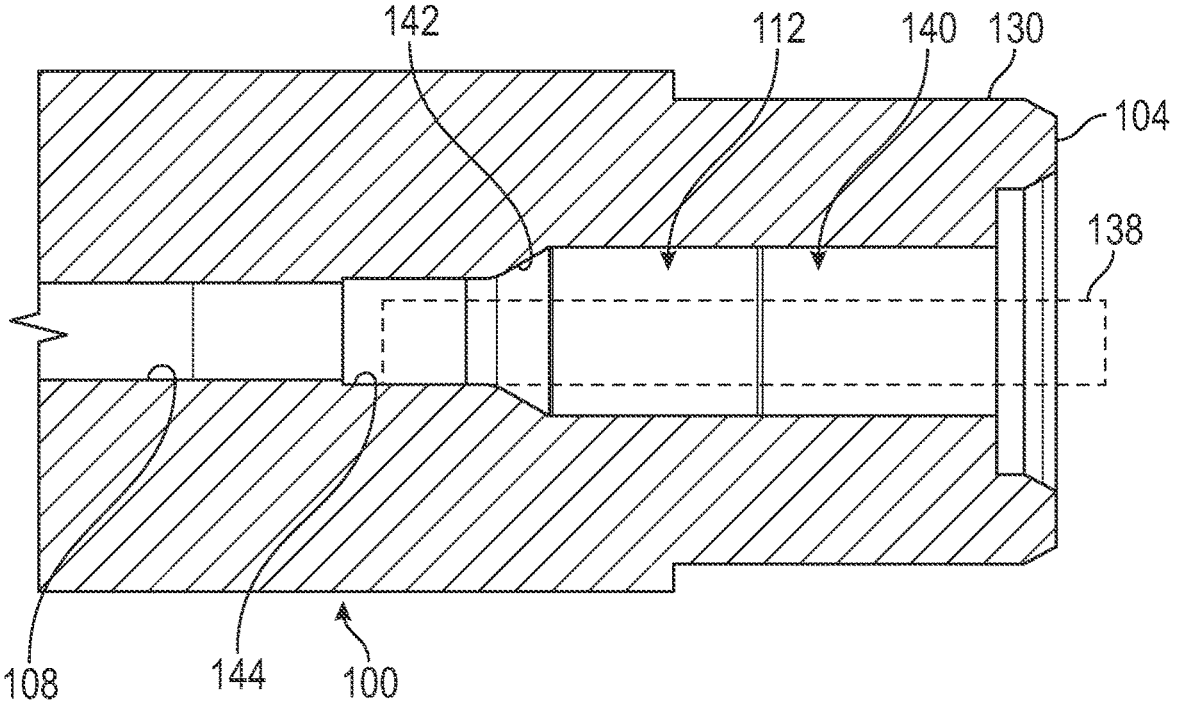
FIG. 7C is a side sectional view of the barrel blank secured in a fixture of FIG. 1 undergoing milling to form the neck.
Figure 8:
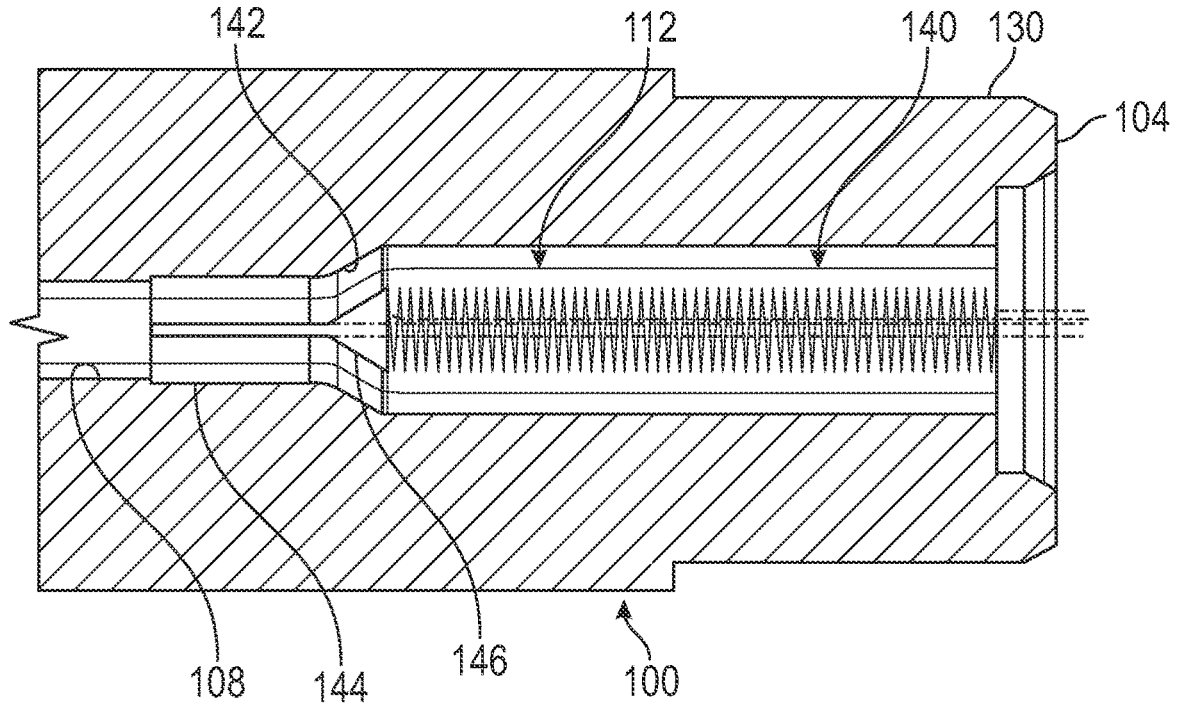
FIG. 8 is a side sectional view of the barrel blank secured in a fixture of FIG. 1 showing the milling tool path to form the complete chamber.

FIGS. 7A-C and 8 illustrate the barrel blank 100 secured in a fixture 102 suitable for use with the improved method of forming a chamber in a barrel blank 10 of the present invention. More particularly, the machining steps to complete a chamber 112 utilizing the center of the bore determined by the second probe are shown. First, an end-mill 138 mills the upper chamber 140 (FIG. 7A). Then, the end-mill mills the shoulder and fillets 142 (FIG. 7B). Finally, the end-mill mills the neck 144 to complete the chamber (FIG.

7C). The milling tool path 146 shown in FIG. 8 indicates the movements made by the end-mill from start to finish to complete the chamber.

Current medium-sized production CNC horizontal machine tools and lathes weight at least 10,000 to 15,000 lbs. In contrast to the typical manual lathe or CNC tool-room lathe's weight of 1,500 to 3,000 lbs., the larger CNC production lathe's weight ensures an order of magnitude of greater rigidity, assuming the work holding technique takes advantage of the lathe's mass. An example of such a production lathe is a ST-20Y CNC lathe, which has a hydraulic collet system that ensures a more rigid form of work holding. The work piece (barrel blank) is inserted in the collet with the breech end protruding 2" to 3" from the end of the collet.

The tools on the CNC machine tool are held in tool blocks positioned on the lathe's turret. Some of these tools are static, while others are live tools. The static tools are used like a conventional lathe, while the live tools allow another axis of rotation, e.g., an endmill may be used in a live tool to machine the workpiece while the workpiece is held stationary in the collet. The use of live tools allows M&Gs the means to cut a chamber without spinning the workpiece. This is significant because it is no longer necessary to use less ridged work holding applications in the attempt to make the ID concentric to the OD with respect to the static tool. For example, in addition to the C-axis of rotation of the main spindle, the ST-20Y has three axes of movement available for the live tool holder, where the conventional lathe only has two available. Unlike typical machine lathes, the centerline of the axial live tool may be positioned to the center of the ID of the bore. In general, this movement of the "work offset" from the main spindle centerline to another coordinate must be accomplished by a specialized machine tool, e.g., a live tool lathe, mill, or other type of machine tool capable of off-centerline axial milling.

The classical methods of indicating in a barrel and then machining with chamber reamers is a time-consuming process that requires the barrel's bore to be lined up to the tool. Typical daily throughput is about 1 to 2 barrels per full time equivalent (FTE) using the classical methods. This throughput may be increased significantly, approximately 4 to 6 times, using an off-centerline axial chambering CNC machine tool. Also, the chamber cut with a CNC machine tool using conventional end-mills is much more consistent from chamber to chamber because tool-deflection and too-wear are easily factored into the finished chamber. Finally, certain aspects of the chamber may be very easily customized by changing a parameter in the CAD drawing, where using classical methods requires the use of another reamer to be obtained and resulting in a much greater time to completion, i.e., reduced throughput.

However, the increase in proficiency, consistency, and flexibility using an off-centerline axial chambering CNC machine tool to produce a precision rifle chamber are not without challenges. The precision rifle barrel blanks that M&Gs use come from specialized barrel (blank) makers who must drill a 30+" hole on a piece of 416R or similar steel for a precision long range rifle barrel. The drilled hole is not going to be perfectly straight, and the bore ID will not be perfectly concentric with the barrel OD. Since the barrel blank is rigidly held in a CNC machine tool by clamping the workpiece, i.e., barrel blank, into the collet, the tool must be lined up to a point inside the bore that will provide a concentric chamber to the bore centerline. The bore ID centerline is found by proprietary software developed specifically for this purpose using a probe tool supplied by the machine tool provider. The probe software finds the point at a set depth dependent upon the type of chamber specified which is concentric to the ID of the pre-drilled bore to within a tolerance of 0.0005".

In addition to drilling the bore, the rifle barrel manufacture will cut rifling into the barrel's bore. The rifling is an arrangement of spiral grooves on the inside of a rifle barrel. The high points of the bore are called the lands, and the low points are called the grooves. The lands tend to be much narrower than the grooves. Because of the rifling, proprietary software is developed to find the true center of the rifled bore. Once the center of the bore has been found, the coordinate for that center point is stored as a work offset. This work offset becomes the zero point for most chamber machining operations.

The classical methods of chambering almost exclusively rely upon the use of specially shaped reamers, called chamber reamers. A different reamer or set of reamers is required for every type of chamber that an M&G will cut. This can easily number in the hundreds, and therefore may be very costly. Also, a reamer follows a pre-drilled hole. In the case of a chamber reamer, it must slowly bore out the chamber by following the pre-existing bore. Since the bore is rarely concentric with the OD of the barrel and is not straight, a reamer cannot work in the setup previously described. Therefore, a probe or other ID indicating instrument must be used to find the work offset as close as possible to the throat of the chamber. If a reamer were used to cut the chamber, the chamber would likely be out of specification because of the possibility of excessive runout caused by the reamer trying to follow the pre-drilled bore. To address this issue, the chamber is milled with end-mills in the current embodiment, i.e., a new hole (the chamber) is cut to line up with the bore at the critical point as close as possible to the proposed throat area.

Machining a shaped precision rifle chamber is not an easy task. However, the current invention provides the benefit of using a small number of tools to chamber hundreds of different sizes of chambers and enables the use of a probe to automate the determination of the bore ID. The current invention develops proprietary tool paths using a CAD/CAM system and the results of experiments with numerous end mill combinations, which enables the production of high precision custom chambers with an appropriate finish.

Because the barrel OD is not concentric with the bore ID, the barrel tenon is machined and threaded using the same work offset as is used when machining the chamber using live tooling. This cannot be accomplished using a lathe in the classical setup. Using live tooling to machine the tenon ensures that the bore ID is centered on the bolt.

To address the challenges of utilizing CNC machines to machine rifle barrels, the current invention has developed new manufacturing processes. Shaped chamber reamers are not used in machining the rifle chamber. Instead, standard machine tooling, end-mills, are used to create the chamber. A detailed production process follows, most of which is unique to creating a precision rifle chamber.

Computer Aided Design (CAD) is used to design the chamber. A major advantage of designing a chamber with CAD and machining with an endmill as opposed to using a shaped reamer is that the machining results can be easily customized. For example, the machining of a non-standard neck size for a chamber is simply addressed by changing the dimension on the CAD drawing. No additional tooling expenses or time are necessary to make these types of custom adjustments.

Several machining steps are necessary to make the chamber. These include forming a rough upper chamber shoulder and neck, finishing the upper chamber, chamfering the upper chamber, finishing the upper fillet, finishing the shoulder, finishing the lower fillet, finishing the neck, chamfering the neck, and live tool milling on the chamber. The barrel blank is placed securely in the collet. Then, the tenon and the bolt nose recess are shaped, and the upper chamber is drilled. These operations are preformed using standard lathe type operations, i.e., the workpiece spins at high speed while the cutter remains essentially stationary. The tooling moves very slowly relative to the spindle speed towards the centerline of the workpiece (the X-Axis) and towards the spindle (the Z-axis). Since these operations are roughing in the dimensions, the precise location of the bore is not a major consideration for these operations.

One of the most time-consuming tasks for traditional chamber manufacturing operations is aligning the rifled bore to the tool. The probe operation utilized by the current invention uses probe macros provided by the probe manufactures in addition to proprietary software developed in-house to find the diameter of the bore to within 0.0005". The resulting X & Y coordinates to the throat area of the chamber are then computed and stored as the live tool work-offset. The probe also finds the Z coordinate work-offset used to establish the headspace for the firearm chamber. The resulting work offset cartesian coordinates, along with the C-axis rotation (around the Z-axis), ensure that the probe only uses the grooves for finding the diameter. After the probe has found the work offset that precisely aligns the live tool to the throat region of the bore, the tenon is finished using endmills and threaded using a thread-mill. This ensures the finished chamber will precisely align with the bolt nose and firing pin center.

Multiple tool paths are used for the different operations required to machine the chamber. For most chambers, only one or two different sized end-mills are necessary. High pressure coolant increases tool life and improves surface finish. The tools may be reused hundreds of times for many different sizes of chambers, resulting in huge savings in tooling costs compared to the numerous reamers required by traditional manufacturing methods.

While a current embodiment of a method of forming a chamber in a barrel blank has been described in detail, it should be apparent that modifications and variations thereto are possible, all of which fall within the true spirit and scope of the invention. Although rifles have been disclosed, the method of forming a chamber in a barrel blank is also suitable for use with shotguns, light and medium machine guns, and other firearms. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A method of forming a chamber in a barrel blank comprising:

providing an elongated firearm barrel blank defining a bore and having a muzzle end and an opposed breech end;

securing the blank in a fixture;

determining a first reference location of the bore at a position proximate to the breech end;

based on the reference location, machining a first rough chamber bore at the breech end and along the bore to a selected depth;

determining a second reference location of the bore at a position beyond the selected depth; and based on the second reference location, machining a second precision chamber bore.

2. The method of claim 1 wherein the provided barrel blank is stationary during the steps of determining and machining.

3. The method of claim 1 wherein the step of determining a first reference location comprises probing a surface of the bore.

4. The method of claim 1 wherein the step of determining a first reference location includes probing at least two different positions about the bore.

5. The method of claim 1 wherein the provided barrel blank has a rifled bore with lands and grooves, and wherein the step of determining a first reference location includes probing a surface of a groove.

6. The method of claim 1 wherein the provided barrel blank has a rifled bore with lands and grooves, and wherein the step of determining a first reference location includes probing a surface of a land.

7. The method of claim 1 wherein the step of determining a first reference location comprises calculating a center of the bore.

8. The method of claim 7 wherein the step of machining a first rough chamber includes centering the first rough chamber on the determined first reference location.

9. The method of claim 1 wherein the blank has an outside surface at the breech end and wherein determining a reference location is irrespective of the outside surface.

10. The method of claim 1 including after determining a first reference location of the bore, rough machining an external barrel feature proximate the breech end.

11. The method of claim 10 wherein the external feature includes a barrel tenon.

12. The method of claim 1 wherein machining a second precision chamber bore includes maintaining the barrel blank stationary, and operating a machine tool having a moving cutting surface to form the chamber.

13. The method of claim 1 wherein machining a first rough chamber bore includes generating a rough chamber surface, and wherein machining a second precision chamber bore includes removing the entire rough chamber surface.

14. The method of claim 1 wherein determining a second reference location of the bore includes inserting a probe having an operational measuring tip, and having an elongated body portion having a diameter greater than the barrel blank bore.

* * * * *